United States Patent [19]

Herchenbach et al.

[11] Patent Number: 4,541,151

[45] Date of Patent: Sep. 17, 1985

[54] WATCH STRAP WITH A CATCH, PARTICULARLY ARTICULATED STRAP

[75] Inventors: Wolfgang Herchenbach; Dieter Nischwitz, both of Pforzheim, Fed. Rep. of Germany

[73] Assignee: Rodi & Wienenberger AG, Pforzheim, Fed. Rep. of Germany

[21] Appl. No.: 553,471

[22] Filed: Nov. 18, 1983

[30] Foreign Application Priority Data

Nov. 24, 1982 [DE] Fed. Rep. of Germany ... 8232954[U]
Nov. 26, 1982 [DE] Fed. Rep. of Germany ... 8233252[U]
Jan. 15, 1983 [DE] Fed. Rep. of Germany ... 8300986[U]

[51] Int. Cl.[4] ..... A44C 5/18

[52] U.S. Cl. ..... 24/265 WS; 24/71 J; 24/174; 24/629

[58] Field of Search ..... 24/629, 630, 631, 173, 24/174, 265 WS, 71 R, 71 J, 70 J, 176

[56] References Cited

U.S. PATENT DOCUMENTS

| | | | |
|---|---|---|---|
| 505,473 | 9/1893 | Mehring | 24/174 |
| 1,739,464 | 12/1929 | Jones | 24/71 J |
| 3,042,277 | 7/1962 | Stradella | 24/265 WS |
| 3,404,440 | 10/1968 | Weiss | 24/265 WS |
| 3,685,107 | 8/1972 | Epiard | 24/265 WS |
| 4,000,542 | 1/1977 | Omichi | 24/70 J |
| 4,398,324 | 8/1983 | Bakker et al. | 24/629 |
| 4,414,714 | 11/1983 | Kostanecki et al. | 24/265 WS |

FOREIGN PATENT DOCUMENTS

| | | | |
|---|---|---|---|
| 367622 | 7/1982 | Austria . | |
| 1022078 | 3/1966 | United Kingdom | 24/631 |
| 2055416 | 3/1981 | United Kingdom | 24/279 |
| 2087471 | 5/1982 | United Kingdom . | |

*Primary Examiner*—Victor N. Sakran
*Attorney, Agent, or Firm*—Michael J. Striker

[57] ABSTRACT

An articulated watch band provided with a catch mechanism interconnected by hinge joints is disclosed. One catch part is formed with a recess and the other part is formed with an extension snugly fitting the recess. To secure the extension in position within the recess, the extension is provided at its lower side with a stop plate and at its upper side with a movable arresting plate corresponding in shape to the outline of the extension, so that upon angular displacement of the upper plate or upon shifting the same in longitudinal direction of the strap, the plate overlaps the rims of the recess in the receiving catch part and prevents the displacement of the extension in vertical direction relative to its upper surface. Hinge joints of the strap include hinge tubes which are secured to the associated links or catch parts by laser-beam welding.

18 Claims, 12 Drawing Figures

WATCH STRAP WITH A CATCH, PARTICULARLY ARTICULATED STRAP

BACKGROUND OF THE INVENTION

The invention relates to a watch strap provided with a catch, particularly an articulated watch strap in which the links and the catch parts are interconnected by hinge joints.

Numerous types of watch straps of this kind are known from prior art, which are provided with a two-piece catch designed in such a manner that one catch piece serves as a receptacle for the other catch part. In one or the other catch part an interlocking mechanism is installed.

In the German Pat. No. 1,170,183 a two-piece catch is described in which the receiving part has a U-shaped cross section and is provided with a longer arm at the intermediate range of which a knob-like suspension member is attached for engaging a recess in the other part. The catch mechanism is provided with an interlocking device consisting of a sleeve in which a threaded pin provided at its outer end with a transverse latch, is screwed with friction. In the completely screwed in position of the threaded pin the transverse catch is situated above the two interlocked catch parts.

Another embodiment of catch mechanisms described in this patent is provided with a shiftable latch which engages by means of a tongue the lower part of the knob-like suspension member.

From the German Pat. No. 1,557,440 a catch is known wherein one catch part is provided with a pin insertable in transverse direction to the length of the strap into a bore in the other catch part. A turnable arm provided with a pressure knob and with a rib snaps with the latter in a groove in the first catch part and is arrested in the closing position by an additional pin and bore connection.

Furthermore, from the Swiss Pat. Nos. 563,742 and 563,743 catches are known with which one of the catch parts is provided with a hook-shaped suspension part which is introduced in an aperture in the other catch part where it is hooked up. A rotary bolt provided with a little semicircular plate or a nose is arranged in the interior of the receiving catch part. By rotating this bolt, the little plate or the nose is shifted over the suspension part and ensures the latter against dropping out.

The constructions of the prior-art catches of this kind are very complex and hence expensive in manufacture. In addition, the insertion of the suspended part in the receiving catch part in the looped watch strap is difficult, inasmuch as the suspension part must be guided with minimum play behind the knob-like suspension member, or the pin must be guided in a narrow bore, or the hook-shaped suspension part must be inserted in a narrow gap in the receiving catch member. In order to open or close the locking mechanism in the prior-art catch devices according to the aforedescribed Swiss patents, there is necessary an additional auxiliary means such as a coin or the like. Moreover, the prior art catch parts have a completely different configuration than the links of the strap, so that they contrast with the latter and do not form a harmonious unit with the watch strap.

In watch straps of the aforedescribed kind, the strap links and the catch parts are usually interconnected by hinge joints. For this purpose, there are employed hinge tubes which are secured to the strap links and to the catch parts by soldering. Due to the minute dimensions of hinge tubes, whose size in temporary superflat strap links still decreases, the soldering process encounters many problems. For example, it is very difficult to apply the correct amount of solder. When too much solder is applied, then the excess rushes out, and the passages must be cleaned in an aftertreatment process. If, on the other hand, too little solder is applied, the hinge tubes are prone to disconnect easily from the links or catch parts when subject to loading. In addition, care must be taken that the solder is uniformly distributed over the entire surface to be soldered, so that the hinge tubes be not attached to the assigned link or catch part at an oblique angle.

Due to high temperatures resulting during the soldering process, the metal of the strap links or catch parts, as well as the hinge tubes themselves, become decolorized in the range of the soldering point, and consequently a further mechanical or galvanic aftertreatment is necessary.

Since sheet or rolled gold is qualitatively better and has also a better wearing quality than a galvanically applied gold layer, it is preferred in the trade to use articulated watch straps or bands whose links and catch parts are provided on its upper side with a rolled gold coating. In soldering hinge tubes on such strap links, there again appears the problem of discoloration due to high soldering temperature. Since the rolled gold coating is provided only on the upper side of the strap links and catch parts, while the other portions are uncoated, a galvanic aftertreatment for restoring the color of the upper surface is no longer possible, inasmuch as the other portions, which should remain free, would become coated. The method of selective plating for recovering a perfect upper surface would be also inapplicable, because of its considerable cost.

Due to the required precision and precaution during the soldering of hinge tubes to the strap links or catch members and the necessary aftertreatment for cleaning the soldered points the assembly is time-consuming and makes the manufacture of such strap links with catch parts very expensive. The attachment of hinged tubes to the links or catch parts by welding is hitherto impossible.

SUMMARY OF THE INVENTION

It is therefore a general object of the present invention to overcome the aforementioned disadvantages.

More particularly, it is an object of the invention to provide an improved watch strap, particularly an articulated watch strap having rolled gold coating on the upper side of its links and catch members, whose catch parts have an unconspicuous appearance and are in harmony even with contemporary superflat watch straps.

Another object of this invention is to provide such an improved watch strap whose catch can be opened and closed easily without the aid of additional means.

Still another object of this invention is to provide such an improved watch strap whose structural parts are simple to manufacture and can be produced and assembled at reduced cost.

Furthermore, an object of this invention is to provide a catch whose function is absolutely reliable.

Still another object of this invention is to provide a watch strap whose catch has a configuration corresponding to the remaining links of the strap.

An additional object of this invention is to provide a novel method by means of which the hinge tubes can be attached to the assigned links or catch parts in a fast and absolutely clean manner, so that any aftertreatment can be dispensed with.

In summary, the objective of this invention is to produce an attractive-looking watch strap, particularly an articulated strap with a catch mechanism which consists of uncomplicated component parts.

In keeping with these objects and others which will become apparent hereafter, one feature of the invention resides, in a combination which comprises strap links and catch parts of substantially uniform thickness, the catch part at one end of the strap having a C-shaped configuration defining a recess and the catch part at the other end of the strap having an extension snugly fitting into the recess and being provided at its lower side with a stop member which permits the insertion of the extension in the recess from the lower side only, the recess and the extension having a shape which prevents any angular displacement between the two catch parts in their plane, and the hinge tubes serving for hinge joints being secured to the assigned strap links or catch parts by laser-beam welding.

In one embodiment of the catch of this invention, the recess in the C-shaped catch part, and the complementary extension on the other catch part, have the outline in the shape of a hammer.

In another embodiment of the catch of the watch strap of this invention, the recess and the complementary extension on respective catch parts have serrated opposite sides, so that the teeth of the extension can engage the teeth in the recess at different positions. In this manner, the watch strap is adjustable in length within certain limits.

In still another embodiment of this invention, the recess and the complementary projection of the catch have the shape of a square whose sides form an angle of 45° to the longitudinal sides of the strap.

For locking the catch having the hammer-like configuration of the extension on one catch part, there is provided an arresting plate rotatably supported on the upper surface of the extension, so that upon its rotation by 90° it overlaps the upper surface of the other, C-shaped catch member, so that the extension cannot be displaced in vertical direction.

In the second embodiment of this invention, where the match catch parts have serrated opposite sides, the arresting plate is displaceable in longitudinal direction of the strap, so that upon its displacement by half the distance between the meshing teeth the two catch parts are secured against vertical displacement.

In the third embodiment of this invention, in which the recess and the matching extension on the two catch parts have the tilted square configuration, there is again provided a rotary arresting plate on the complementary salient which is rotatable about 45°, so as to overlap the sides of the C-shaped catch part, thus arresting the salient in its engaged condition.

The catch mechanism of this invention is also characterized by the feature that the extension on the other catch part is provided with a throughbore for receiving a shaft whose upper face is attached to the arresting plate and whose lower face is attached to the stop member, preferably in the form of a disk, so that upon suspension of the extension in the recess of the C-shaped catch part, both parts are held in the same plane.

The shaft is again provided with spring-biased arresting elements which resiliently hold the arresting plates in fixed angular positions.

In one modification of the watch strap of this invention, both the shaft and the throughbore have circular cross-sections. The shaft in this case is formed with a transverse throughbore in which a helical spring with a metal ball at each end thereof is accommodated. The throughbore in the extension is in the range of movement of the transverse throughbore in the shaft, provided with uniformly distributed semispherical recesses which receive the spring-biased balls and secure the shaft and hence the arresting plate in the adjusted angular position.

In the embodiment of this invention where the extension and recess in respective catch parts are shaped with serrated opposite sides, the throughbore in the extension is in the form of a rectangular slot in which a rectangular shaft is shiftable in longitudinal direction of the strap. Also, in this example, the shaft is formed with a transverse throughbore accommodating a biasing spring with two metal balls which engage corresponding notches in the opposite lateral walls of the throughbore in the extension. The lower end face of the shaft carries the stop member in the form of a disk, and the upper end face of the shaft carries a serrated arresting plate which is shiftable in the longitudinal direction of the strap by half a tooth to secure the catch parts in the engaged condition.

The third embodiment, similarly as the first one, has again an extension formed with a throughbore of circular cross section for receiving a cylindrical shaft, the latter is provided with a transverse throughbore for accommodating the biasing spring with securing metal balls which engage the indexing notches in the cylindrical wall of the throughbore in the extension. The arresting plate on the upper end face of the shaft, which has a square shape, is thus rotatable to predetermined angular positions in which it either coincides with the square recess so that the catch part can be disengaged, or overlaps the sides of the recess so that the catch parts are secured one to another.

To facilitate the rotation or the shifting of the upper arresting plate, the latter is provided at its lower side with oblique flanks.

The catch designed in accordance with this invention consists of a few uncomplicated parts. All structural elements are intentionally designed in simple shapes which can be easily manufactured at low cost. Also, the assembly of the securing device in the catch part formed with the extension does not present any problems and can be quickly accomplished.

The construction of the catch of this invention makes the coupling of the two catch parts very easy, inasmuch as the elements to be interconnected are of a relatively large area and no narrow slots or minute bores for interconnecting the catch parts are involved. Due to the exact fit of the contours of the matching catch parts, the resulting catch is extremely flat. Only the thin rotating or shiftable arresting plate serving for securing the catch in its closed position projects above the upper surface of the strap. The opposite stop plate at the lower surface of the strap is completely invisible when the strap is in use.

The catch of this invention offers a particularly elegant, unobtrusive solution for contemporary superflat watch straps. It is a flat, compact unit which is in harmony with the appearance of the strap, particularly due to the fact that the hinge tubes serving for joining the links and the catch parts together, are welded to lower chamfered edges of the links and of the catch parts and are completely out of view when the strap is used. According to another feature of this invention, this invisible welding of the hinge tubes to the strap links or to the catch part is performed by a laser beam which is directed at both ends of the hinge tube at an oblique angle in the openings of the tube. The inner wall portion of the hinge tube impinged upon by the laser beam welds at this point with its substrate, that is with a body of the links or of the catch parts. Hence, the welding point at the contact surface of the hinge tubes with the links or catch parts are invisible. It is possible in this manner to produce additional welding points by rotating the links or catch parts together with the hinge tubes about a small angle about the center axis of the tubes and after each angular displacement applying the laser beam directly in the openings in the manner as described above.

In a modification, the laser beam is not directed obliquely in the opening against the inner wall portion of the hinge tube, but is directed at right angles against the outer surface of the tubes, whereby the energy of the beam is adjusted such that a hole is first burnt out in the front wall of the hinge tube and subsequently the opposite wall portion, which is in contact with the substrate, is welded to the latter. In this modification, only the hole in the front wall portion of the hinge pipe is visible. This minute hole, however, does not disturb, inasmuch as in the completely assembled articulate watch strap the hinge tubes are always covered by the adjoining link or catch part.

Due to the fact that burning area of a laser beam is extremely small, the welding point, even at small dimensions of the hinge pipes, can be exactly positioned. The welding energy if desired can be adjusted over a large range, so that the spilling of welded material, as is the case for example in soldering, does not occur. The loading energy can be accurately dosed and exactly concentrated at the point to be welded. Accordingly, there is no danger of overheating the adjoining areas of the links or catch parts and no discoloration on the hinge tubes or on the links or on the catch parts, or on the rolled gold coatings takes place, and any aftertreatment is unnecessary. The hinge tubes, even in the case of links and catch parts provided with rolled gold coatings, are secured to the substrate in a clean and reliable manner and withstand all loads occurring during the usage of the watch strap.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
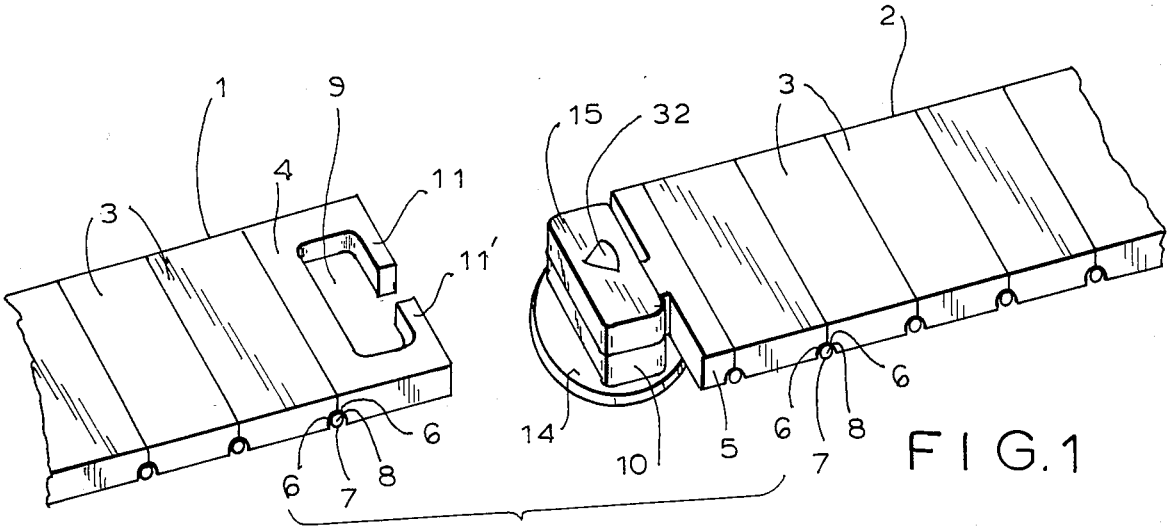
FIG. 1 is a perspective view of a cut away part of a watch strap of this invention with a first embodiment of its catch shown in its open position.
Figure 2:
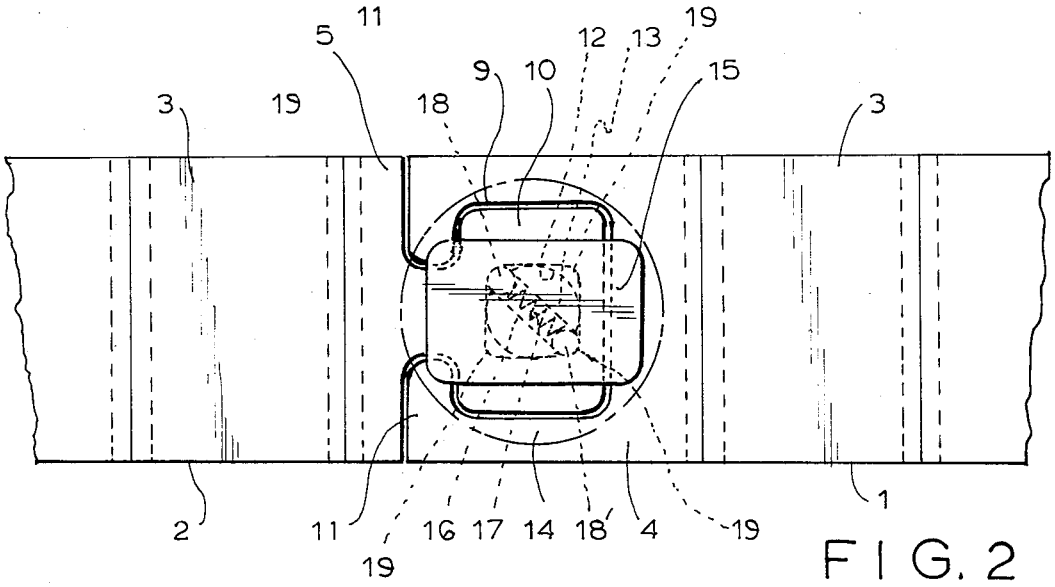
FIG. 2 is a top view of the watch strap of FIG. 1 with a catch in its closed position.

The watch strap of this invention consists of two strap halves 1 and 2, each consisting of a series of links 3 and of a terminal catch part 4 or 5 interconnected by means of hinge joints. The links 3 and the catch parts 4 and 5 are provided at their lower edges with recesses 6 extending transversely to the longitudinal direction of the strap. The radius of curvature of these recesses corresponds to the radius of the hinge pipes 7, and the diameter of the pipes corresponds to the depth of the grooves 6, so that the hinge pipes are fully accommodated in the recesses 6. Pins 8 pass through the hinge pipes of the adjoining links to hold the articulated watch strap together.

Figure 3:
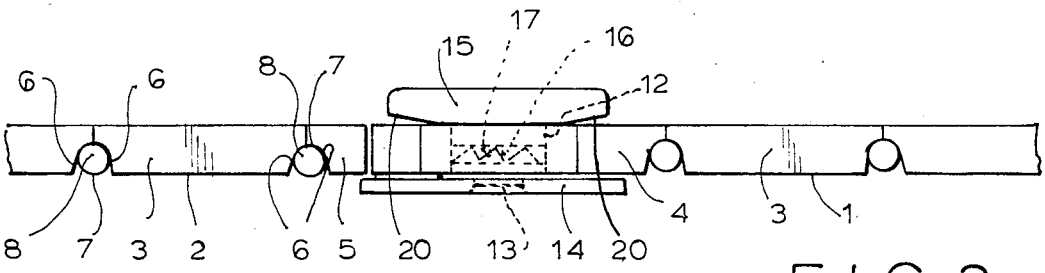
FIG. 3 is a side view of the catch of FIG. 2.

The catch of the watch strap of this invention consists of two catch parts 4 and 5 hinged to the free ends of the strap halves 1 and 2. The catch part 4 at the end of the strap part 1 has a C-shaped configuration, defining a cut-out 9 which in the first embodiment according to FIGS. 1 and 3 has the form of a hammer head. The other catch part 5 is shaped with a complementary extension 10 corresponding in outline to the recess 9. The two catch parts are interconnected by inserting the hammer-shaped extension 10 into the corresponding recess 9 in the other catch part. The juxtaposed flaps 11 and 11' at the mouth of the C-shaped catch part 4 act as a stop for the inserted hammer-shaped extension 10, so that the latter is firmly held in the plane of engagement.

The extension 10 of the catch part 5 has a throughbore 12 extending from the upper surface to the lower one and supporting for rotation a shaft 13, the lower end face of which is attached to a circular stop plate 14. The stop plate 14 permits the insertion of the extension 10 in the recess 9 of the other catch part 4 from below only. The two catch parts 4 and 5 are thus aligned in a single plane. The upper end face of the shaft 13 is secured to an arresting plate 15, whose outline corresponds to the outline of the hammer head part of the extension 10. The arresting plate 15 serves for locking the catch in its closed position. When the plate 15 is rotated by 90°, then due to its elongated configuration it overlaps the upper sides of flaps 11 and 11' at one end and overlaps also the longitudinal side of the extension 10 at the other end. In this manner the catch parts are locked in their closed position.

To secure this closed position, the shaft 13 is provided with a diametrical bore 16 in which resilient arrest elements are accommodated, such as for example a helical spring 17 engaging at both ends thereof metal balls 18 and 18' which in turn jump into notches 19 in the inner wall of the throughbore 12 in the hammer-shaped extension 10. By turning the upper plate 15 in a plane parallel to the upper surface of the extension 10 to a position at which the longitudinal sides of the plate 15 are at right angles to the longitudinal sides of the extension, the balls 18 jump into the notches 19 and the arresting plate 15 is secured in its closing position. In order to facilitate the actuation of the plate 15, the latter in all embodiments of this invention is provided at its lower surface with oblique flanks or undercuts 20. The oblique undercuts facilitate the grip by fingers, and in rotary arrangement of the arresting plate they also facilitate the rotation in the closing position.

Figure 4:
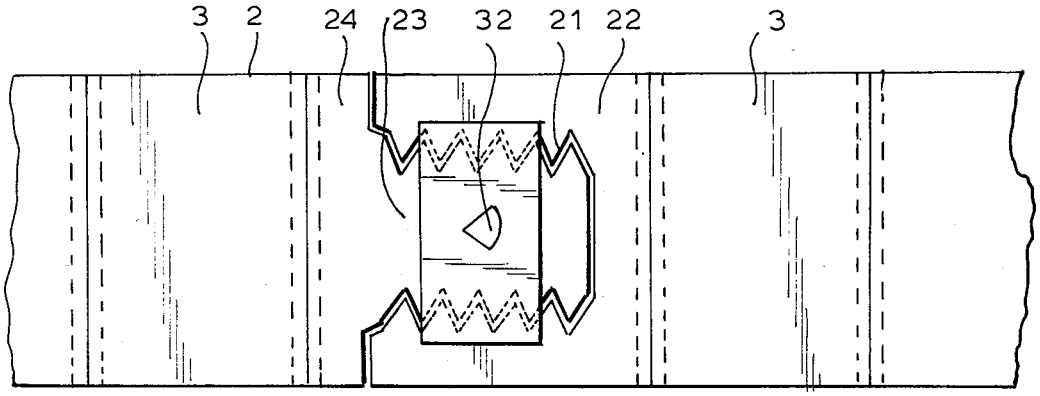
FIG. 4 is a top view of another embodiment of the catch for a watch strap provided with a rotatable securing plate shown in its arresting position.

In the other embodiment of the catch mechanism according to FIG. 4, the cut-out 21 in one catch part 22, as well as the match extension 23 of the other catch part 24 have serrated opposite sides. The extension 23, which in this embodiment can be engaged with corresponding teeth in the recess 21 at several different positions. In this manner, the length of the watch strap can be adjusted within certain limits.

The mechanism for fixing the catch in its closed position can be of the same construction as described above, that means it can include a cylindrical shaft rotatable in a cylindrical throughbore in the extension 23 and supporting on its upper end face an arresting plate which when rotated by 90° it transversely overlaps the cut-out 21 of the catch part 22. The lower end face of the shaft, similarly as in the preceding example, is also attached to a stop disk which prevents the disengagement of the teeth in vertical direction (FIG. 4).

In a modification of the mechanism for fixing the catch according to FIG. 4, the serrated extension 23 is provided with an arresting plate 25 which has exactly the same serrated outline as the extension 23. When the arresting plate 25 is displaced in longitudinal direction of the strap about half the root of the teeth, then the teeth of the arresting plate and of the engaged catch parts are staggered relative to each other and the overlapping parts prevent the disengagement of the catch parts in vertical direction.

Figure 5:
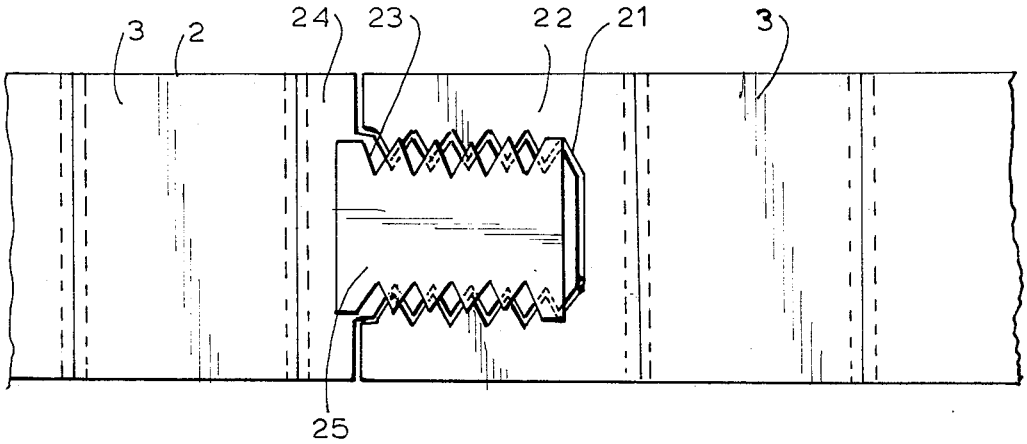
FIG. 5 is a top view of still another embodiment of the catch for the watch strap of this invention shown in its closed position with a shiftable arresting plate.
Figure 6:
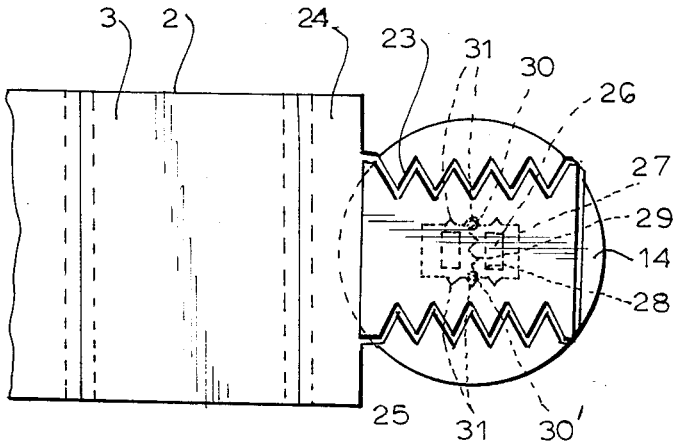
FIG. 6 is a top view of a catch part of FIG. 5 shown with a rectangular supporting shaft for the arresting plate, the latter being shown in its open position.
Figure 7:
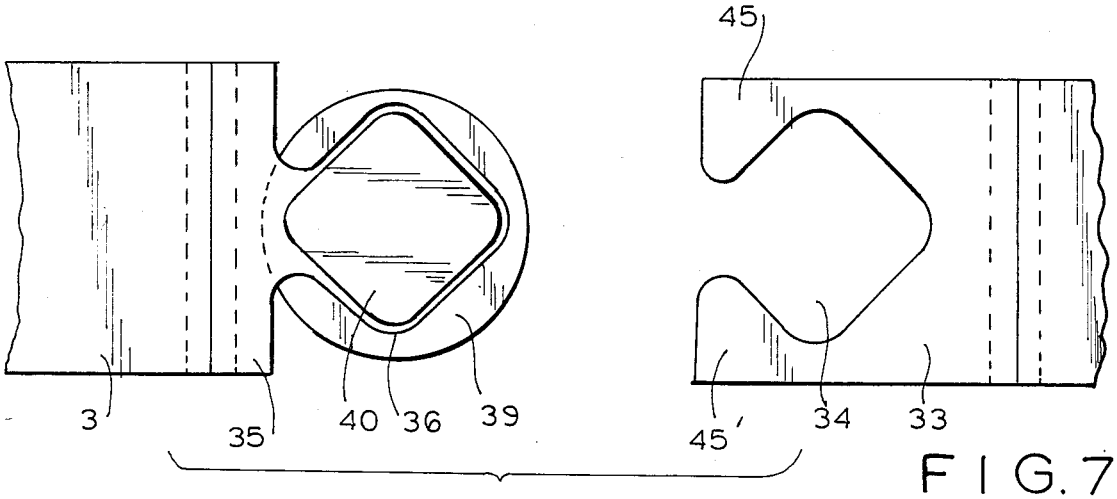
FIG. 7 is a top view of still another embodiment of the catch for the watch strap of this invention, shown in its disengaged condition.
Figure 8:
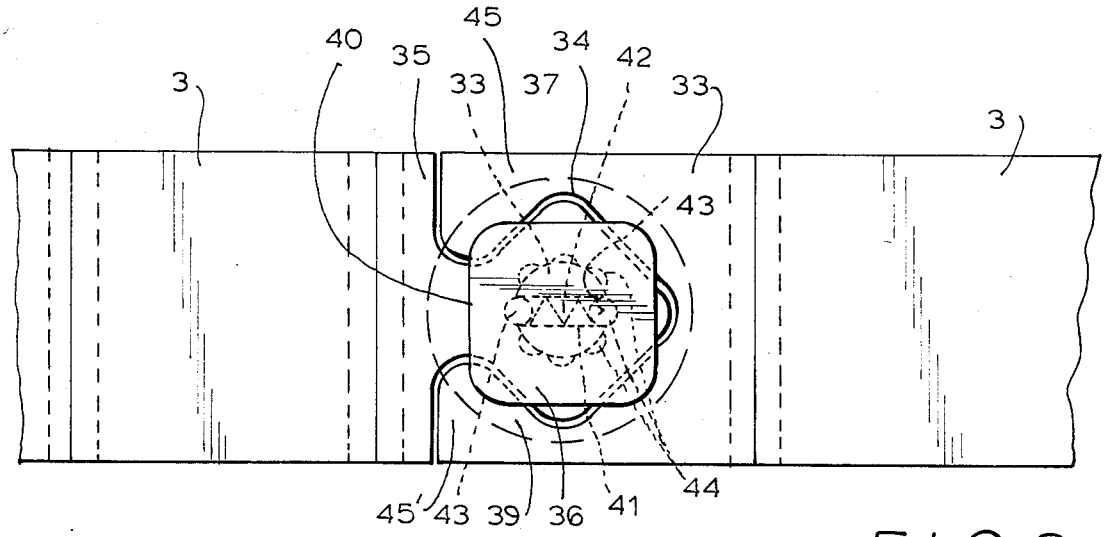
FIG. 8 is a top view of the catch of FIG. 7, shown in its closed or engaged condition.
Figure 9:
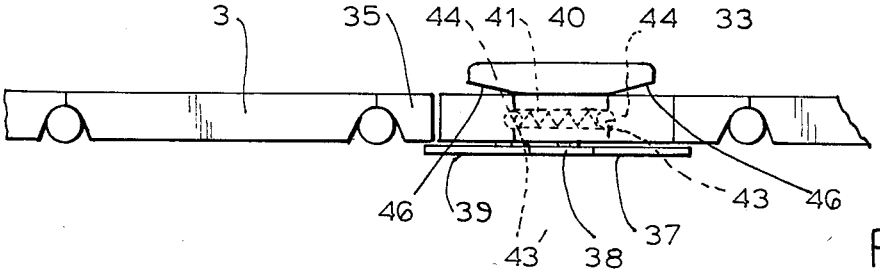
FIG. 9 is a side view of the catch of FIG. 8.

The mechanism for fixing the plates 25 either in an open position in alignment with the teeth of the catch parts or in a closing position in which the teeth on the plates 25 are shifted about a half tooth with respect to the engaged teeth of the catch part, is designed such that the shaft 26 which supports the plates 25 has a rectangular cross section and is shiftable in a throughbore 27 (FIG. 5). The shaft 26 is also provided with a transverse bore 28 in which a helical spring 29 is accommodated, which biases at each end thereof a metal ball 30 and 30' against the inner walls of the rectangular throughbore 27. In shifting the upper plate 25 in the longitudinal direction of the strap, the metal balls 30 and 30' jump in corresponding pairs of recesses 31 in the inner wall of the slot 27 and fix the plate in one of the two arresting positions. If desired, emblems 32 can be secured to the upper surface of plates 15, 25 and 40.

In another preferred embodiment of this invention, the catch part 33 is provided with a recess or cut-out 34 which has the outline of a square tilted by 45° relative to the longitudinal sides of the watch strap. The catch part 35 has a correspondingly shaped extension 36 fitting the square shape of the recess 34.

The fixing mechanism for the catch has in this example also a circular throughbore 37 for supporting a cylindrical shaft 38 whose lower end face is connected to a circular plate 39, whereas the upper end face of the shaft 38 is connected with a square arresting plate 40 matching the outline of the extension 35.

Similarly as in the preceding examples, the shaft 38 has a diametrical throughbore 41 in which the resilient stop elements are accommodated, such as helical spring 42 engaging at its ends metal balls 43 and 43'. The corresponding inner wall portions of the throughbore 37 are in the range of movement of the balls 43 and 43', provided with grooves 44 which hold the plate in one of its positions.

In closing the catch, the catch part 35 is first inserted from below in the catch part 33. During this coupling step, the rotary plate 40 is oriented parallel to the supporting extension 36. The catch extension 36 fits snugly in the catch cut-out 34, and the flanks or lugs 45, 45' at the mouth of the cut-out 34 limit in horizontal direction the movement of the extension 36. The circular lower plate 39 limits the movement of the catch part 33 in vertical direction, and consequently both catch parts 33 and 35 lie in one plane. The upper plate 40, which has a flat shape only negligibly projecting above the upper surface of the catch parts, is rotated by 45° to lock the engaged catch parts. The corners of the plate 40 in this position cover the sides of the cutout 34, thus arresting the underlying extension 36 and prevent its displacement in upright position. The stop balls 43 and 43' at the ends of the biasing spring 42 jump during the rotation in the corresponding notches 44 in the inner wall of the bore 37 and fix the upper plate 40 in the desired position, either in alignment with the square extension 36 or in an angular position of 45° relative to the latter.

The lower flanks 46 of the plate 40, similarly as in the preceding embodiments, are inclined at a sharp angle relative to the upper surface of the extension.

Figure 10:
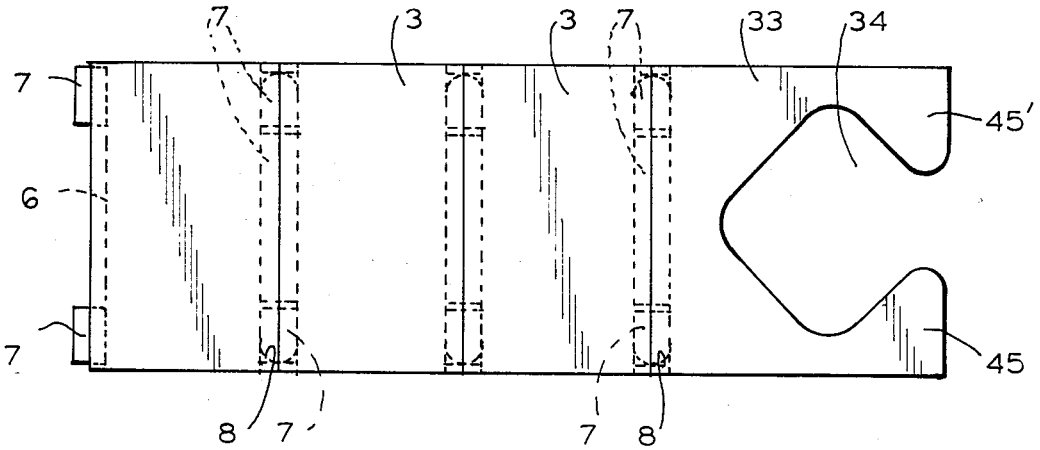
FIG. 10 is a top view of a section of the articulated watch strap of this invention having the C-shaped catch part.
Figure 11:
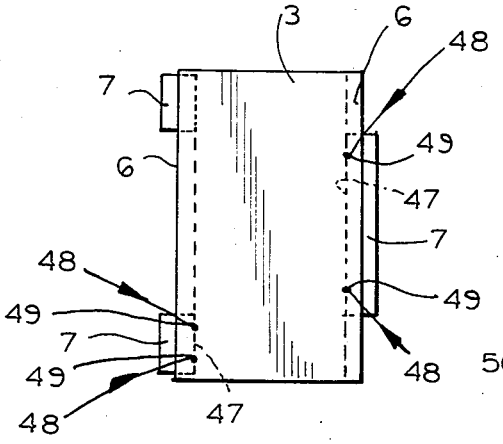
FIG. 11 is a link of a watch strap of this invention shown with hinge tubes welded to the link at two points by a laser beam applied at an oblique angle to the openings of the tubes.
Figure 12:
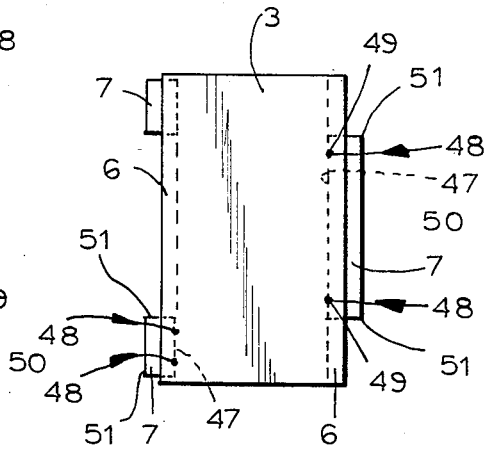
FIG. 12 shows the link of the watch strap in which the hinge tubes are welded to the substrate by a laser beam applied at right angles to the upper surface of the tubes.

FIGS. 10–12 illustrate the method how the links 3 and the catch parts 33 are connected one to another by means of hinge tubes 7 and connecting pins 8.

FIG. 11 illustrates a first method of attachment of the hinge tubes to the underlying straplinks by laser-beam welding, during which a laser beam is introduced at an acute angle against the contact surface to be welded through the end openings of the hinge tubes. Since the weld point 49 in laser beam welding process is extremely small, to increase the strength of the connection it is possible by this method to produce several welding points arranged side-by-side by rotating the link about the center axis of the tube.

In the modification according to FIG. 12, the hinge tubes 7 are secured to the links by laser beam welding, at which laser beams are directed through a hole 51 in the upper surface of the tube which has been burned through by the laser beam 48. The opposite inner wall 47 of the tube 7 is welded at welding points 49 to the underlying groove 6 of the link 3 or of the catch part 33.

It will be understood that each of the elements described above, or two or more together, may also find a useful application in other types of constructions differing from the types described above.

While the invention has been illustrated and described as embodied in specific examples of articulated watch straps with catch means, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A watch strap with a catch, particularly an articulated strap interconnected by hinge joints, comprising strap links and catch parts of substantially uniform thickness; one catch part at one end of the strap having a substantially C-shaped configuration defining a recess, and the other catch part at the other end of the strap having an extension snugly fitting in the recess and being flush with the one catch part in a plane; a stop member arranged at the lower side of the extension of the other catch part to permit the insertion of the extension in the recess from the lower side of the strap only; the recess and the extension having a shape which prevents shifting and/or angular displacement between the two catch parts in said plane; an arresting plate arranged on the upper surface of said extension; and the hinge joints including hinge tubes which are secured to the assigned links and catch parts by laser-beam welding points.

2. A watch strap as defined in claim 1, wherein the outline of the recess in the one catch part and of the extension in the other catch part have a hammer-like shape.

3. A watch strap as defined in claim 1, wherein the recess in the one catch part and the extension in the other catch part define respectively two opposite serrated sides oriented in the longitudinal direction of the strap.

4. A watch strap as defined in claim 3, wherein the two opposite serrated sides in each catch part extend parallel to each other so that the serrated extension can engage different teeth in the serrated recess and the catch is thus adjustable in length.

5. A watch strap as defined in claim 1, wherein the recess in the one catch part and the extension of the other catch part have each a shape of a square tilted by 45° relative to the longitudinal sides of the strap.

6. A watch strap with a catch, particularly an articulated strap interconnected by hinge joints, comprising strap links and catch parts of substantially uniform thickness; one catch part at one end of the strap having a substantially C-shaped configuration defining a recess, and the other catch part at the other end of the strap having an extension snugly fitting in the recess and being flush with the one catch part in a plane; a stop member arranged at the lower side of the extension of the other catch part to permit the insertion of the extension in the recess from the lower side of the strap only; the outline of the recess in the one catch part and of the extension in the other catch part having a hammer-like shape which prevents angular displacement between the two catch parts in said plane; hinge joints including hinge tubes which are secured to the assigned links and catch parts by laser-beam welding points; and the hammer-shaped extension on the other catch part being provided on its upper surface with a rotatable plate corresponding in outline to the hammer-like shape of the extension, so that upon turning of the plate by 90° the latter overlaps the upper surface portions of the C-shaped catch part and prevents displacement of the extension in vertical direction.

7. A watch strap as defined in claim 4, wherein said arresting plate is shiftable in longitudinal direction of the strap, the plate having the same shape as the serrated extension, so that after shifting the plate by half a root distance of the teeth the plate overlaps the teeth on the C-shaped recess and prevents the displacement of the extension in vertical direction.

8. A watch strap with a catch, particularly an articulated strap interconnected by hinge joints, comprising strap links and catch parts of substantially uniform thickness; one catch part at one end of the strap having a substantially C-shaped configuration defining a recess, and the other catch part at the other end of the strap having an extension snugly fitting in the recess and being flush with the one catch part in a plane; a stop member arranged at the lower side of the extension of the other catch part to permit the insertion of the extension in the recess from the lower side of the strap only; the recess and the extension having a shape which prevents angular displacement between the two catch parts in said plane; hinge joints including hinge tubes which are secured to the assigned links and catch parts by laser-beam welding points; the recess in the one catch part and the extension of the other catch part having each a shape of a square tilted by 45° relative to the longitudinal sides of the strap; the square-shaped extension being provided on its upper surface with a square-shaped plate rotatable about the center axis of the extension, so that upon rotation of the plate about 45° it overlaps upper surface portions of the C-shaped catch part and prevents the extension from displacement in vertical direction.

9. A watch strap with a catch, particularly an articulated strap interconnected by hinge joints, comprising strap links and catch parts of substantially uniform thickness; one catch part at one end of the strap having a substantially C-shaped configuration defining a recess, and the other catch part at the other end of the strap having an extension snugly fitting in the recess and being flush with the one catch part in a plane; a stop member arranged at the lower side of the extension of the other catch part to permit the insertion of the extension in the recess from the lower side of the strap only; the recess and the extension having a shape which prevents angular displacement between the two catch parts in said plane; hinge joints including hinge tubes which are secured to the assigned links and catch parts by laser-beam welding points; the extension having at its center a throughbore of a circular cross section, a shaft supported for rotation in the throughbore, said stop member being in the form of a circular plate secured to the lower end face of the shaft and exceeding the perimeter of the recess in the one catch part, and an arresting plate secured to the upper end face of the shaft to permit, in one angular position of the shaft, the insertion of the extension in the recess and to overlap, in another angular position of the shaft, the upper surface of the C-shaped catch part so as to prevent displacement of the extension in vertical direction.

10. A watch strap as defined in claim 9, wherein the shaft is formed with a diametrical throughbore and is provided with resilient stop elements arranged in the throughbore to secure the shaft in predetermined angular positions thereof.

11. A watch strap as defined in claim 10, wherein the stop elements include a helical spring and two balls arranged at respective ends of the spring, and the inner wall of the throughbore in the extension being formed in the range of the diametrical throughbore in the shaft with notches for engaging the balls in said predetermined angular positions.

12. A watch strap as defined in claim 9, wherein the throughbore in the extension is in the form of an elongated rectangular slot which is oriented in the longitudinal direction of the strap, said shaft having a rectangular cross section and being slidable in the throughbore in the longitudinal direction thereof, said shaft having a transverse throughbore for accommodating resilient stop elements in the form of a helical spring provided at its ends with metal balls, and the opposite inner sides of the slot-like throughbore in the extension being formed with notches for engaging the metal balls in predetermined positions of the shaft.

13. A watch strap as defined in claim 12, wherein the extension, and the recess in respective catch parts have at least one serrated side respectively, and the plate secured to the upper end face of the shaft being serrated in accordance with the extension and the recess, so that about shifting the plate about a distance of half a root size of the teeth the extension is arrested in its engaged position.

14. A watch strap as defined in claim 10, wherein the recess and extension of respective catch parts have a configuration of a square tilted by 45° relative to the longitudinal sides of the strap, said plate on the upper end face of the shaft having a corresponding square configuration, and the shaft being formed with a diametrical throughbore for accommodating resilient stop elements in the form of a helical spring having a metal ball at respective ends thereof, and the inner wall of the throughbore in the extension being provided, in the range of movement of the diametrical throughbore in the shaft, with notches for engaging the metal balls in predetermined angular positions of the shaft.

15. A watch strap as defined in claim 9, wherein the plate at the upper surface of the extension has inclined lower side portions to facilitate gripping of the shell by the user.

16. A method of welding hinge tubes to an articulated watch strap of the type which includes strap links interconnected by hinge joints, catch parts of substantially uniform thickness, one catch-part at one end of the strap defining a recess, and the other catch part at the other end of the strap having an extension snugly fitting in the recess and being flush with the one catch part in a plane, a stop member arranged at the lower side of the extension of the other catch part to permit the insertion of the extension in the recess from the lower side of the strap only, and the hinge joints including hinge tubes which are secured to the assigned links and catch parts by laser-beam welding points, the method comprising the steps of placing the hinge tubes in contact with a lower surface of the links and catch parts of the strap, and then directing a laser beam at an acute angle through the end openings of the tubes against the contact area of the hinge tube with the underlying link or catch part until a weld point is produced.

17. A method of welding as defined in claim 16, wherein after completion of one weld point the hinge tubes together with the attached links or catch part is rotated about a small angle about the center axis of the tube and the laser beam is directed through the inlet opening to produce another weld point.

18. A method of welding hinge tubes to an articulated watch strap of the type which includes strap links interconnected by hinge joints, catch parts of substantially uniform thickness, one catch part at one end of the strap defining a recess, and the other catch part at the other end of the strap having an extension snugly fitting in the recess and being flush with the one catch part in a plane, a stop member arranged at the lower side of the extension of the other catch part to permit the insertion of the extension in the recess from the lower side of the strap only, and the hinge joints including hinge tubes which are secured to the assigned links and catch parts by laser-beam welding points, the method comprising the steps of placing a hinge tube in contact with the lower surface of a strap link or catch part, then directing a laser beam at right angles to the center axis of the tube against a front surface portion of the latter, adjusting the energy of the laser beam to burn out a hole in the front wall portion and to weld the opposite wall portion with a contacting link or catch part.

* * * * *